US005678361A

United States Patent [19]

Bair

[11] Patent Number: 5,678,361

[45] Date of Patent: Oct. 21, 1997

[54] RAIN DIVERTER FOR A FOLDABLE ROOF

[76] Inventor: Alan F. Bair, c/o Pacific Yurts, Inc. 77456 Hwy. 99S, Cottage Grove, Oreg. 97424

[21] Appl. No.: 639,298

[22] Filed: Apr. 24, 1996

[51] Int. Cl.[6] ..... E04D 13/00

[52] U.S. Cl. ..... 52/24; 52/97; 135/115; 135/120.1; 135/127; 135/128

[58] Field of Search ..... 52/24, 25, 63, 52/13, 97; 248/65, 49; 135/131, 156, 147, 115, 120.1, 127, 126, 128, 143

[56] References Cited

U.S. PATENT DOCUMENTS

| | | | |
|---|---|---|---|
| 3,371,671 | 3/1968 | Kirkham | 135/156 X |
| 3,951,159 | 4/1976 | Robinson et al. | 135/156 X |
| 4,745,936 | 5/1988 | Scherer | 135/156 X |
| 4,858,635 | 8/1989 | Eppenbach | 135/156 X |
| 5,005,322 | 4/1991 | Mattick et al. | 52/25 |
| 5,205,086 | 4/1993 | Heim | 135/156 X |
| 5,301,705 | 4/1994 | Zheng | 135/126 |
| 5,337,772 | 8/1994 | Habchi | 135/143 X |

*Primary Examiner*—Wynn E. Wood
*Assistant Examiner*—Timothy B. Kang
*Attorney, Agent, or Firm*—David S. Alavi

[57] ABSTRACT

A protruding ridge type rain diverter for a foldable roof for a tent, canopy, yurt, or other portable shelter is described, comprising: at least one elongated strip of foldable roof material sealedly attached to the roof along both long sides of the strip thereby forming an elongated pocket, and an elongated substantially transversely incompressible member positioned within each pocket, thereby maintaining each pocket in a protruding position relative to the roof. The position and shape of the pocket(s) facilitate flow of runoff from the roof away from entryway, door, and/or window openings of the portable shelter.

4 Claims, 2 Drawing Sheets

RAIN DIVERTER FOR A FOLDABLE ROOF

FIELD OF THE INVENTION

The field of the present relates to foldable roofs for portable shelters such as tents, canopies, or yurts. In particular, a protruding ridge type rain diverter for a foldable roof for a portable shelter is described herein for diverting runoff from the roof away from entryway, door, and/or window openings below the roof in the side portions of the portable shelter.

BACKGROUND

Portable shelters, such as tents, canopies, or yurts, typically comprise a cover or enclosure made of flaccid material and a structure or framework for supporting the flaccid cover or enclosure. It is frequently desirable that the flaccid material be foldable for transport and/or storage. Materials suitable for use as a portable shelter cover are well known in the art and include, but are not limited to: canvas, nylon, gortex, or any of a variety of polymer coated, laminated, or impregnated fabrics known in the art. The cover material is usually water repellent to some degree in order to protect occupants and contents of the shelter during periods of rain and/or snow, thereby leading to runoff and/or sliding snow from the shelter cover when the shelter is exposed to rain and/or snow.

If left unimpeded, the runoff may flow or the snow may slide down over the edge of the roof portion of the shelter. It is desirable to divert the flow of the runoff and/or the sliding snow away from those portions of the shelter where entryway, door and/or window openings are located. This may be accomplished by a variety of structures. One such structure is a rain fly for a tent as described in U.S. Pat. No. 4,709,718. Another such structure is a tent rain awning as described in U.S. Pat. No. 5,035,253. Both of these cited structures may prevent rain from running off the roof onto areas of the side portions of the shelter where entryway, door and/or window openings are located. However, they suffer from several shortcomings. They are bulky and cumbersome and require additional assembly for deployment. They also add considerably to the size, weight, cost, and complexity of the portable shelter.

An alternative solution for diverting runoff and/or sliding snow away from door and/or window openings comprises providing the roof portion of the shelter with at least one protruding ridge for diverting runoff and/or sliding snow. For the purposes of this specification it is to be understood that any structure referred to as a rain diverter may function by diverting runoff and/or by diverting sliding snow. In FIG. 1 several protruding ridge type rain diverters 102 are shown positioned near the lower edge 106 of foldable roof 104 of a yurt 100. Rain diverters 102 are positioned above door opening 108 or window opening 110 in side portion 112 of yurt 100. Runoff flowing down roof 104 encounters rain diverters 102 and flows along rain diverters 102 instead of continuing down over lower edge 106 of foldable roof 104 and onto door opening 108 or window opening 110. One end 114 of rain diverter 102 is typically lower than the other end 116 so the runoff flows toward end 114 of rain diverter 102 and away from door opening 108 or window opening 110. Alternatively, two rain diverters 102 may be employed with their high ends 116 juxtaposed and positioned above the center of door opening 108 or window opening 110, thereby forming an inverted V structure over the door opening 108 or window opening 110.

In order to allow the roof material of the portable shelter to be foldable, previous protruding ridge type rain diverters have been fabricated from the same or similar material as the roof. A cross section of such a diverter is shown in FIG. 2. An elongated strip 202 of roof material is folded along its long dimension and sealedly attached to the roof material 204 by means well known in the art, such as sewing, gluing, chemical welding, thermal bonding, electronic welding, combinations thereof, or functional equivalents thereof. The resulting protruding ridge 200 may then function as a rain diverter when the roof is deployed as part of a portable shelter, but still allows the roof to be folded for transport and/or storage.

There are several fundamental disadvantages to the previous design for a protruding ridge type rain diverter. The roof material must possess sufficient stiffness to maintain a protruding ridge type structure in order to function properly. This limits the materials which may be used to fabricate a portable shelter roof with rain diverters, precluding use of many lighter weight materials which are not sufficiently stiff. Even when a sufficiently stiff material is used, repeated folding and unfolding of the roof, exposure to wind, rain, sun, temperature extremes, and/or other weather conditions, and/or wear lead to loss of stiffness of the protruding ridge rain diverter, which therefore ceases to function properly.

SUMMARY OF THE INVENTION

Certain aspects of the present invention may meet one or more of the following objects:

To provide a rain diverter for a foldable roof for a portable shelter for diverting runoff and/or sliding snow that is not bulky or cumbersome, requires minimal additional assembly for deployment, and minimizes additional size, weight, cost, and/or complexity of the portable shelter.

To provide a protruding ridge type rain diverter for a foldable roof which may be fabricated from any foldable roof material regardless of the stiffness of the material.

To provide a protruding ridge type rain diverter for a foldable roof which continues to function properly after repeated folding and unfolding of the foldable roof, after prolonged exposure to wind, rain, sun, temperature extremes, and/or other weather conditions, and/or after the foldable roof becomes worn.

These objects are achieved by a protruding ridge type rain diverter for a foldable roof comprising: an elongated strip of foldable roof material sealedly attached to the roof along both long sides of the strip thereby forming an elongated pocket; and an elongated substantially transversely incompressible member positioned within the pocket, thereby maintaining the pocket in a protruding position relative to the roof.

When the foldable roof is deployed, insertion of the substantially transversely incompressible member into the elongated pocket results in a protruding ridge which may act as a rain diverter to divert runoff and/or sliding snow. One end of the pocket may be positioned higher on the roof than the other to facilitate flow of runoff along the rain diverter toward the lower end. Alternatively the central portion of the pocket may be higher on the roof than the ends to facilitate flow of runoff toward both ends of the rain diverter. The roof may be fabricated from any suitable foldable roof material since the protrusion of the ridge is maintained by the substantially transversely incompressible member, and not by the stiffness of the foldable roof material. Removal of the member from the pocket allows the roof to be more readily folded for transport and/or storage. The performance of the rain diverter is unaffected by repeated folding and unfolding of the roof, prolonged exposure to wind, rain, sun, temperature extremes, and/or other weather conditions, and/or wear of the foldable roof.

DETAILED DESCRIPTION OF THE PREFERRED EMBODIMENTS

Figure 1:
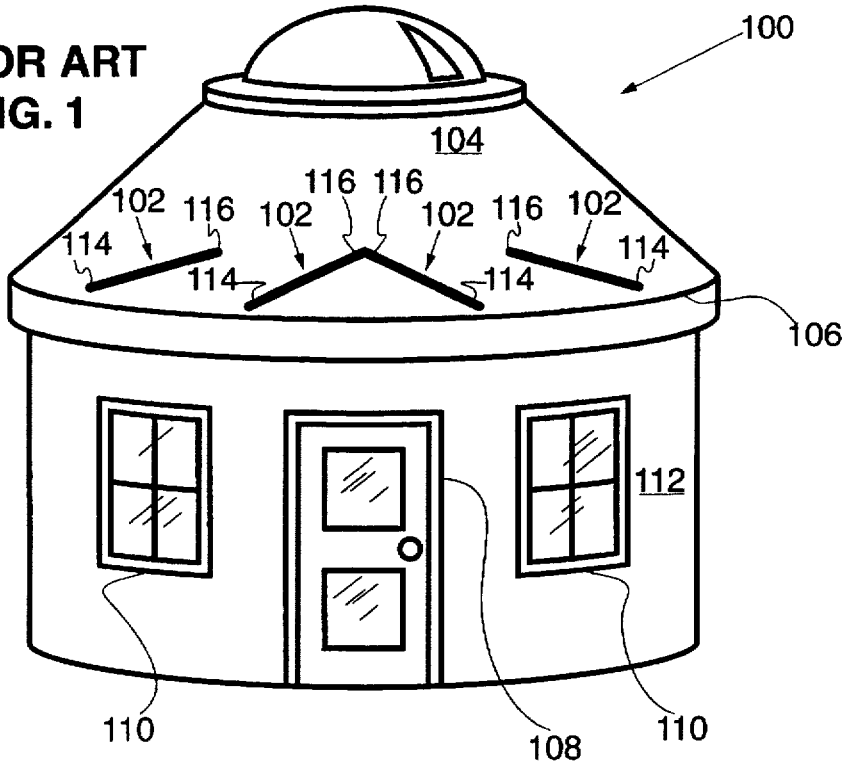
PRIOR ART FIG. 1
FIG. 1 is a perspective view of a yurt with several previous protruding ridge type rain diverters.
Figure 2:
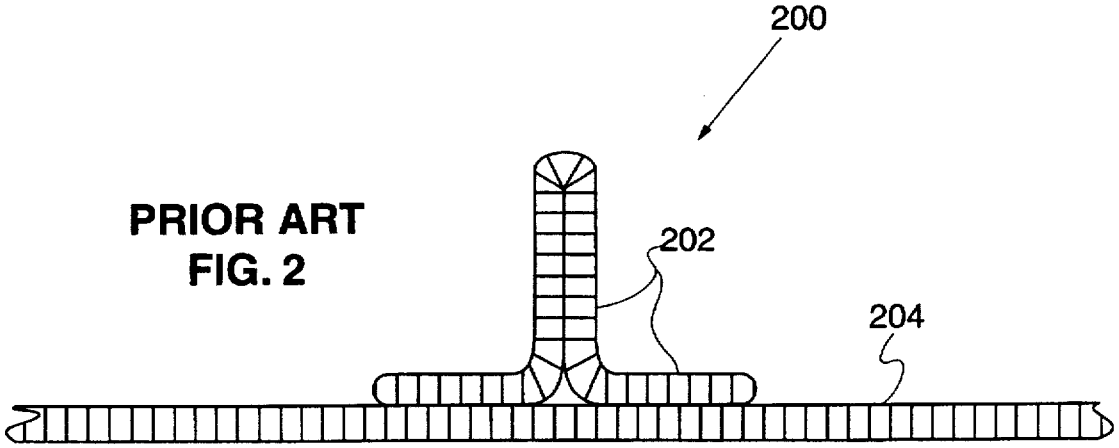
PRIOR ART FIG. 2
FIG. 2 is a cross sectional view of a previous protruding ridge type rain diverter.
Figure 3:
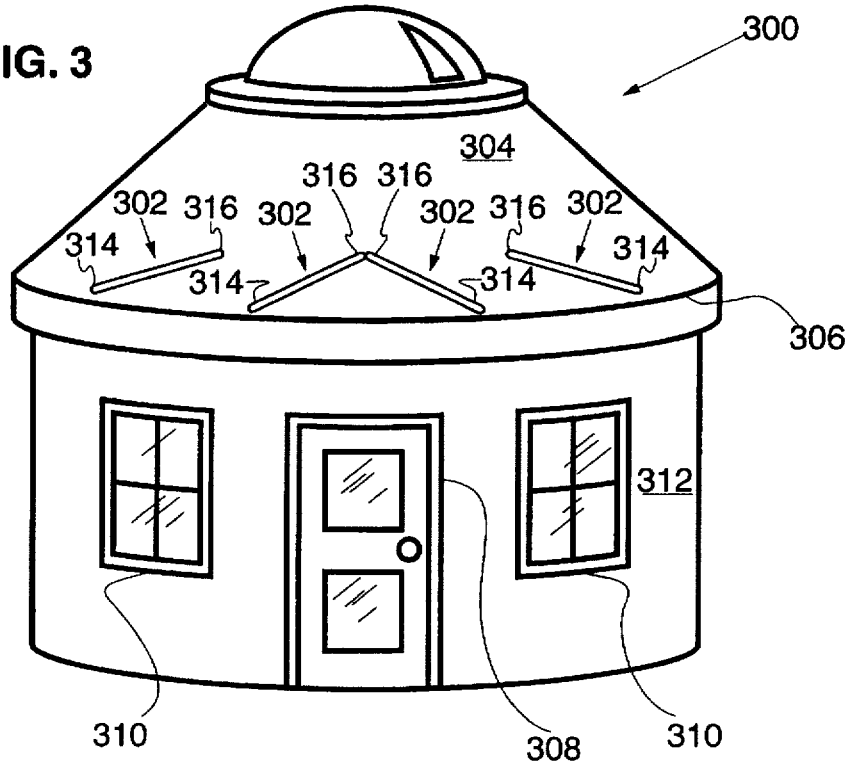
FIG. 3 is a perspective view of a yurt with several protruding ridge type rain diverters according to the present invention.

In FIG. 3 several protruding ridge type rain diverters 302 according to the present invention are shown positioned near the lower edge 306 of foldable roof 304 of a yurt 300. In a preferred embodiment of the present invention, rain diverter 302 comprises an elongated pocket into which a substantially transversely incompressible elongated member may be inserted, thereby maintaining the elongated pocket in a protruding position relative to roof 304. For purposes of this specification transversely incompressible refers to any elongated member which retains its cross sectional shape despite the application of transverse force. Rain diverters 302 are positioned above door opening 308 or window opening 310 in side portion 312 of yurt 300. Runoff flowing down roof 304 encounters rain diverter 302 and flows along rain diverter 302 instead of continuing down over lower edge 306 of foldable roof 304 and onto door opening 308 or window opening 310. One end 314 of rain diverter 302 is typically lower on roof 304 than the other end 316 so the runoff flows toward end 314 of rain diverter 302 and away from door opening 308 or window opening 310. In a preferred embodiment of the present invention, two rain diverters 302 may be employed with their high ends 316 juxtaposed and positioned above the center of door opening 308 or window opening 310, thereby forming an inverted V structure over the door opening 308 or window opening 310. Rain diverter 302 may also function to divert snow which may slide down roof 304, thereby preventing accumulation of snow from roof 304 in front of door opening 308 or window opening 310.

Figure 4:
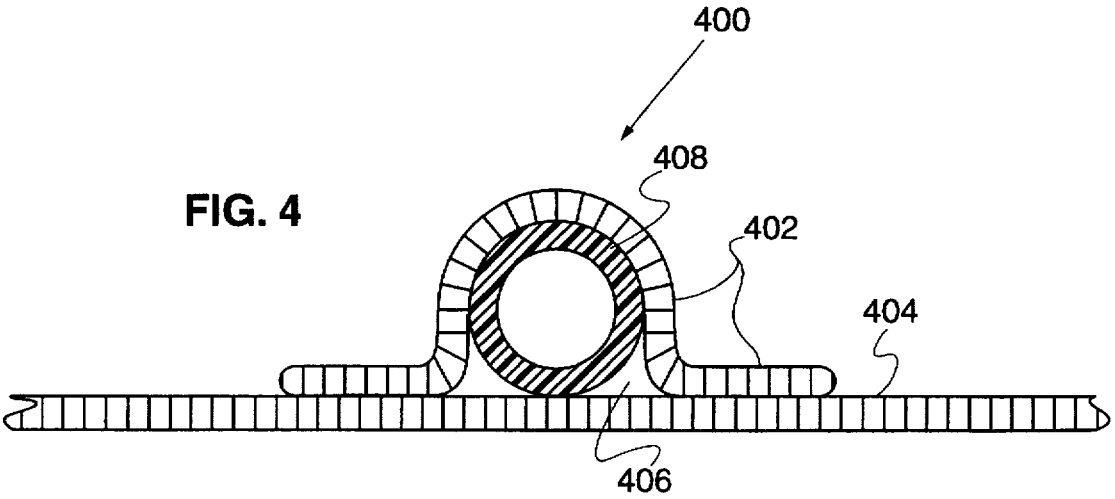
FIG. 4 is a cross sectional view of a protruding ridge type rain diverter according to the present invention.

In order to allow the roof material of the portable shelter to be readily foldable, in a preferred embodiment of the present invention protruding ridge type rain diverters 302 are fabricated from the same or similar foldable material as roof 304. A cross section of rain diverter 302 is shown in FIG. 4. An elongated strip 402 of roof material is sealedly attached along both of its long sides to roof material 404 by means well known in the art. At least one end of the resulting elongated pocket 406 remains open to receive the substantially transversely incompressible elongated member, which in a preferred embodiment of the present invention comprises a 1.5 inch outside diameter cylindrical plastic tube 408. Preferably tube 408 may be retained within pocket 406 by folding the end of strip 402 into the end of tube 408. Tube 408 maintains pocket 406 in a protruding position relative to roof material 404. The resulting protruding ridge 400 may then function as a rain diverter when the roof is deployed as part of yurt 300 or other portable shelter. When yurt 300 or other shelter is disassembled, tube 408 may be readily removed from pocket 406, thereby allowing roof material 404 to be more readily folded for transport and/or storage. Tube 408 may be readily transported and/or stored with other support members of yurt 300 or other portable shelter.

In a preferred embodiment of the present invention, elongated strip 402 comprises the same or similar material as the foldable roof material 404, which may include but is not limited to: canvas, nylon, gortex, any of a variety of polymer coated, laminated, or impregnated fabrics known in the art, combinations thereof, or functional equivalents thereof. In a preferred embodiment of the present invention, elongated strip 402 may be sealedly attached to roof material 404 by means well known in the art, including but not limited to: sewing, gluing, chemical welding, thermal bonding, electronic welding, combinations thereof, or functional equivalents thereof. In a preferred embodiment of the present invention, means for retaining tube 408 within pocket 406 may include folding the end of strip 402 into the end of tube 408, providing the end of pocket 406 with a fastener which may be repeatedly closed and opened, or functional equivalents thereof.

In an alternative embodiment of the present invention, tube 408 may comprise a substantially transversely incompressible lightweight elongated member of arbitrary cross sectional shape, which may or may not be tubular. For example, an elongated batten having a rectangular cross section about 1.5 inches wide and ⅛ inch thick may be employed. Tube 408 or other elongated member may be fabricated from any material sufficiently light to be supported by the foldable roof and sufficiently transversely incompressible to maintain pocket 406 in a protruding position relative to roof material 404, including but not limited to plastic, fiberglass, wood, aluminum, and other functionally equivalent materials.

In an alternative embodiment of the present invention which is not illustrated in the FIGS., pocket 406 may follow a curvilinear path across roof 404, with a highest point of the path on the roof between the ends of pocket 406, whereby runoff flows along the resulting rain diverter 302 from its center portion towards each end. The curvilinear path may descend monotonically from the highest point of the path on the roof to each end. For purposes of this specification the term monotonic shall have its mathematical definition. Therefore the derivative of the height of the curvilinear path with respect to distance along the path from the highest point toward each end may be negative or zero, but not positive. In other words, there may be no low points along the curvilinear path where water might collect. Examples of suitable paths include but are not limited to an arc, an inverted "V", and an inverted "U". Multiple elongated members may be inserted into pocket 406. Alternatively, tube 408 or other elongated member may be sufficiently transversely incompressible to maintain pocket 406 in a protruding position relative to roof 404, but nevertheless sufficiently flexible to conform to the curvilinear path when inserted into elongated pocket 406. The bending of tube 408 or other elongated member is sufficient to retain tube 408 or other elongated member within pocket 406. Members for portable shelters exhibiting such incompressibility, flexibility, and retention are well known in the art.

In an alternative embodiment of the present invention which is not shown in the FIGS., a rain diverter may serve as an attachment point for attaching an awning, rain fly, or other auxiliary structure made from foldable roof material to the roof.

In an alternative embodiment of the present invention which is not illustrated in the FIGS., pocket 406 is completely sealed and is maintained in a protruding position relative to roof material 404 by inflating pocket 406 with air or any other readily available substantially inert gas.

The present invention has been set forth in the form of its preferred embodiments. It is nevertheless intended that modifications to the disclosed rain diverters may be made without departing from inventive concepts set forth herein.

What is claimed is:

1. A rain diverter for a foldable roof, comprising:

at least one elongated strip of foldable roof material comprising two sides and two ends, both sides being sealedly attached to said roof thereby forming an elongated pocket comprising a first end and a second end, and at least one elongated substantially transversely incompressible member comprising a first end and a second end and positioned within said pocket, thereby maintaining said pocket in a protruding position relative to said roof, wherein said pocket is positioned on said roof with the first end of said pocket lower on said roof than the second end of said pocket, thereby facilitating a flow of rain running off said roof toward the first end of said pocket, wherein at least one end of said pocket is open and said member is removably positioned within said pocket, further comprising means for retaining said member within said pocket, and wherein said retaining means comprises a fastener for closing at least one end of said pocket and said fastener may be closed and opened repeatedly.

2. A rain diverter for a foldable roof, comprising:

at least one elongated strip of foldable roof material comprising two sides and two ends, both sides being sealedly attached to said roof thereby forming an elongated pocket comprising a first end and a second end, and at least one elongated substantially transversely incompressible member comprising a first end and a second end and positioned within said pocket, thereby maintaining said pocket in a protruding position relative to said roof, wherein said pocket is positioned on said roof with the first end of said pocket lower on said roof than the second end of said pocket, thereby facilitating a flow of rain running off said roof toward the first end of said pocket, wherein at least one end of said pocket is open and said member is removably positioned within said pocket, further comprising means for retaining said member within said pocket, wherein said member comprises a lightweight tube, and wherein said retaining means comprises folding at least one end of said elongated strip into at least one end of said tube.

3. A rain diverter for a foldable roof, comprising:

at least one elongated strip of foldable roof material comprising two sides and two ends, both sides being sealedly attached to said roof thereby forming an elongated pocket comprising a first end and a second end, a first elongated substantially transversely incompressible member comprising a first end and a second end and positioned within said pocket, thereby maintaining said pocket in a protruding position relative to said roof, a second elongated substantially transversely incompressible member comprising a first end and a second end and positioned within said pocket, thereby maintaining said pocket in a protruding position relative to said roof, wherein said pocket follows a path comprising an inverted V shape, wherein both ends of said pocket are open and wherein said first and second members are removably positioned within said pocket, further comprising means for retaining said members within said pocket, wherein said retaining means comprises fasteners for closing the ends of said pocket and said fasteners may be closed and opened repeatedly.

4. A rain diverter for a foldable roof, comprising:

at least one elongated strip of foldable roof material comprising two sides and two ends, both sides being sealedly attached to said roof thereby forming an elongated pocket comprising a first end and a second end, a first elongated substantially transversely incompressible member comprising a first end and a second end and positioned within said pocket, thereby maintaining said pocket in a protruding position relative to said roof, a second elongated substantially transversely incompressible member comprising a first end and a second end and positioned within said pocket, thereby maintaining said pocket in a protruding position relative to said roof, wherein said pocket follows a path comprising an inverted V shape, wherein both ends of said pocket are open and wherein said first and second members are removably positioned within said pocket, further comprising means for retaining said members within said pocket, wherein each of said members comprises a lightweight tube, and wherein said retaining means comprises folding the ends of said elongated strip into the ends of said tubes.

* * * * *